US007396802B2

(12) United States Patent
Mondal et al.

(10) Patent No.: US 7,396,802 B2
(45) **Date of Patent: *Jul. 8, 2008**

(54) CORROSION INHIBITOR/METAL PASSIVATOR ADDITIVE COMPOSITION FROM WASTE REFINERY STREAMS

(75) Inventors: Pankaj Kumar Mondal, Maharastra (IN); Khem Chand Dohhen, Maharashtra (IN); Rakesh Sarin, Maharashtra (IN); Deepak Kumar Tuli, Maharashtra (IN); Ram Prakash Verma, Maharashtra (IN); Akhilesh Kumar Bhatnagar, Maharashtra (IN)

(73) Assignee: Indian Oil Corporation Limited, Bandra (East) Numbai, Manharashtra (IN)

( * ) Notice: Subject to any disclaimer, the term of this patent is extended or adjusted under 35 U.S.C. 154(b) by 528 days.

This patent is subject to a terminal disclaimer.

(21) Appl. No.: 10/495,267

(22) PCT Filed: Jul. 25, 2002

(86) PCT No.: PCT/IN02/00156

§ 371 (c)(1),
(2), (4) Date: May 10, 2004

(87) PCT Pub. No.: WO2004/011578

PCT Pub. Date: Feb. 5, 2004

(65) Prior Publication Data

US 2005/0032654 A1 Feb. 10, 2005

(51) Int. Cl.
*C10M 135/36* (2006.01)
*C23F 11/00* (2006.01)

(52) U.S. Cl. ..... 508/273; 252/387; 252/395

(58) Field of Classification Search ..... 508/273; 252/387, 395
See application file for complete search history.

(56) References Cited

U.S. PATENT DOCUMENTS

| | | | | |
|---|---|---|---|---|
| 4,246,126 | A | 1/1981 | Arakelian et al. | 252/47.5 |
| 4,591,645 | A * | 5/1986 | Hugo et al. | 548/142 |
| 4,599,425 | A * | 7/1986 | Hugo et al. | 548/142 |
| 5,094,763 | A * | 3/1992 | Tochigi et al. | 508/273 |
| 6,306,288 | B1 * | 10/2001 | Pittman et al. | 208/235 |
| 6,362,137 | B1 * | 3/2002 | Bhatnagar et al. | 508/273 |

* cited by examiner

*Primary Examiner*—Glenn Caldarola
*Assistant Examiner*—Jim Goloboy
(74) *Attorney, Agent, or Firm*—Allen, Dyer, Doppelt, Milbrath & Gilchrist, P.A.

(57) ABSTRACT

The reaction of the disulphided oil, as obtained from the caustic wash of liquefied petroleum gas, with 2,3,8,9,13,14-hexathia-5,6,11,12 -tetraazatricyclo [8.2.1.14,7]tetradeca-4,6,10,12-tetraene was carried out in one pot and one step to yield a corrosion inhibiting composition comprising predominantly of 2,5-bis(methyldithio)-1,3,4-thiadiazole, 2-methylthio-5-ethylthio-1,3,4-thiadiazole and 2,5-bis(ethyldithio)-1,3,4-thiadiazole, for application in fuels, lubes and greases. (I)

12 Claims, No Drawings

CORROSION INHIBITOR/METAL PASSIVATOR ADDITIVE COMPOSITION FROM WASTE REFINERY STREAMS

FIELD OF THE INVENTION

This invention relates to a corrosion inhibitor/metal passivator additive composition for lubricant, grease and fuel applications from waste refinery streams and a process for preparing the same.

BACKGROUND OF THE INVENTION

It is well known that various derivatives of 2,5-dimercapto-1,3,4-thiadiazole are useful lubricant, grease and fuel additives for inhibition of copper activity, i.e., corrosion or staining. Many patents have been issued on various derivatives of 2,5-dimercapto-1,3,4-thiadiazole. Amongst various derivatives of 2,5-dimercapto-1,3,4-thiadiazole, the bisulfides are preferred as corrosion inhibitors/metal passivator additives for lubricants, greases and fuels. These disulfides react with large quantities of sulfur or active sulfur compounds to give compounds, which are non-corrosive to metals, especially copper and silver. Their capacity to react with sulfur is large, as 2,5-bis (dodecyldithio)-1,3,4-thiadiazole is able to react with 16 gram atoms of sulphur and the resulting product is a non-corrosive in modified EMD silver strip test. Thus 2,5-dimercapto thiadiazole disulfides have the ability to act as "sulfur sink".

U.S. Pat. No. 3,087,932 discloses a method of making 2,5-bis( alkyldisulphide)-1,3,4-thiadiazole. This process involves the reaction of hydrogen peroxide with 2,5-dimercapto-1,3,4-thiadiazole or its alkyl metal salt and alkyl mercaptan.

U.S. Pat. No. 4,097,387 describes metal deactivators derived from 2,5-dimercapto-1,3,4-thiadiazole by reaction with sulfur halide and an olefin to form an intermediate, which is then treated with sodium or potassium salt of thiadiazole. More recently, U.S. Pat. No. 4,487,706 describes the preparation of metal deactivator by reacting olefin, sulfur dichloride and 2,5-dimercapto-1,3,4-thiadiazole in a single step.

Other method of making these disulphides of thiadiazole involves reaction of chloromercaptan with 2,5-dimercapto-1,3,4-thiadiazole or formation of 2,5-dimercapto thiadiazole dichloride and subsequent reaction with mercaptans. This latter reaction is specially preferred in view of the high temperature stability of the dichlorides than alkyl sulfenyl chlorides. These methods have been reviewed by Ellis K Fields in Industrial and Engineering Chemistry, Vol. 49, 1957, p. 1361 to 1364; which is incorporated herein as reference.

As can be seen from the above description of the prior-art, the metal deactivator/corrosive inhibiting additives from 2,5-dimercapto-1,3,4-thiadiazole have been prepared either by reaction of thiadiazole with alkyl mercaptans or by using olefins and sulfur dichloride.

The disadvantages of the above processes are:

- Alkyl mercaptans are expensive material and the cost of corrosion inhibitor/metal deactivator additives produced by these procedures becomes very high.
- Methane thiol and ethane thiol have low boiling point of 6° C. and 35° C. respectively and therefore difficult to handle commercially in bulk.
- Methane thiol and ethane thiol have a very strong odour.

In U.S. Pat. No. 4,487,706, during the reaction of thiadiazole with sulfur dichloride and olefin, hydrogen chloride vapours are evolved and the additives contain residual chlorine by introduction of the HCl gas into olefinic unsaturation. This process evolves corrosive HCl gas and the product contains higher amount of chlorine and hence is not advantageous.

Our U.S. Pat. No. 6,362,137 provides a process for preparing a corrosion inhibitor/metal passivator additive for lubricant, grease and fuel applications from waste refinery streams, comprising reacting 2,5-dimercapto-1,3,4-thiadiazole either in powder form or in solution form in polar organic solvent, with disulphide oil obtained from Merox extraction/caustic wash of the refinery streams.

In order to get good yields, a redox reagent like hydrogen peroxide was used. The subsequent reaction with disulfide oil was carried out in the same vessel and therefore some amount of hydrogen peroxide always remained in the mixture. Since the reaction mixture was refluxed in the latter part of the process, a small amount of sulphones resulted from the oxidation of disulfides. Though these sulphones were subsequently removed during the step of hexane extraction, an additional step was introduced. Thus, by the two step synthesis, we reported the preparation of 2,5-bis(alkyldithio)-1,3,4-thiadiazoles by using the disulfides from waste refinery streams and having an average molecular composition of $C_5H_{12}S_2$ to $C_{12}H_{26}S_2$.

SUMMARY OF THE INVENTION

The object of the present invention is to overcome the afore-said disadvantages by providing one step reaction process at much reduced cost.

Yet another objective of the present invention is to further simplify the process of our U.S. Pat. No. 6,362,137, so as to make the process even more cost effective by providing one step reaction process at much reduced cost.

Further the disulfides have exclusively been obtained from the caustic wash/Merox process of abundantly available liquefied petroleum gas.

Chemically the composition of the disulfide oils of the present invention is $C_2H_8S_2$ to $C_4H_{10}S_2$, which had not been explored in the earlier work.

To achieve the said object the instant process comprises reacting 2,3,8,9,13,14-hexathia-5,6,11,12-tetraazatricyclo [8.2.1.14,7]tetradeca-4,6,10,12-tetraene with disulfide oil obtained from waste refinery stream generated during Merox extraction/caustic wash of liquid petroleum gas.

The reaction in one step and one pot yield a corrosion inhibiting composition for lubricant, grease and fuel applications, comprising of 2,5-bis(methyldithio)-1,3,4-thiadiazole, 2-methylthio-5-ethylthio-1,3,4-thiadiazole and 2,5-bis(ethyldithio)-1,3,4-thiadiazole. Thus the need to have an additional redox reagent for better yield has been avoided. The yields are better and sulphone formation does not occur. Hence, the 2,5-bis(alkyldithio)-1,3,4-thiadiazoles have been synthesized from waste refinery streams in a single step. The reaction scheme is as under.

The reaction can also be carried out in the presence of a polar solvent. The said polar solvent is acetonitrile, tetrahydrofuran, methyl ethyl ketone or alkyl alcohols. The said alkyl alcohol is methyl alcohol, ethyl alcohol, isopropyl alcohol or mixtures thereof. However the preferred alcohol is ethyl alcohol. The ratio of the reactants 2,3,8,9,13,14-hexathia-5,6,11,12-tetraazatricyclo [8.2.1.14,7]tetradeca-4,6,10,12-tetraene and disulphide oil is in the ratio 1-2:1:10. The preferred ratio of the reactants 2,3,8,9,13,14-hexathia-5,6,11,12-tetraazatricyclo [8.2.1.14,7]tetradeca-4,6,10,12-tetraene and disulphide oil is in the ratio 1:3.

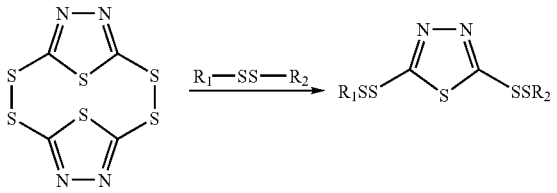

This invention further provides a corrosion inhibiting additive composition for lubricant, grease and fuel applications, comprising of a) 2,5-bis(methyldithio)-1,3,4-thiadiazole: 35-65% by weight b) 2-methylthio-5-ethylthio-1,3,4-thiadiazole: 35-65% by weight and the balance of 2,5-bis(ethyldithio)-1,3,4-thiadiazole in order to make up to 100% by weight.

The additive according to the present invention is of the general formula

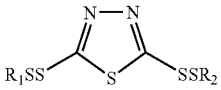

wherein $R_1$ and $R_2$ is selected from $CH_3$ or $C_2H_5$.

When $R_1$ and $R_2$ is $CH_3$, the compound is 2,5-bis(methyldithio)-1,3,4-thiadiazole and when $R_1$ is $CH_3$ and $R_2$ is $C_2H_5$ and the compound is 2-methylthio-5-ethylthio-1,3,4-thiadiazole When $R_1$ and $R_2$ is $C_2H_5$, the compound is 2,5-bis(ethyldithio)-1,3,4-thiadiazole.

The lubricating oil composition comprises of a mixture of 0.01 to 6% of 2,5-bis(methyldithio)-1,3,4-thiadiazole, 2-methylthio-5-ethylthio-1,3,4-thiadiazole and 2,5-bis(ethyldithio)-1,3,4-thiadiazole as the corrosion inhibitor/metal passivator additive, for lubricant, grease and fuel applications.

DETAILED DESCRIPTION OF THE INVENTION 2,5-dimercapto-1,3,4-thiadiazole may be prepared by reacting one mole of hydrazine or hydrazine salt with two moles of carbon disulphide as described in British Patent No. 747,048. Further modification for the synthesis of 2,5-dimercapto-1,3,4-thiadiazole have been carried out and described in U.S. Pat. No. 4,599,425. 2,5-dimercapto-1,3,4-thiadiazole is further oxidized to cyclic 2,3,8,9,13,14-hexathia-5,6,11,12-tetraazatricyclo [8.2.1.14,7]tetradeca-4,6,10,12-tetraene, as described in U.S. Pat. No. 4,599,425.

The disulphide oil of the present invention is produced during the refining operation for production of low sulfur liquidified petroleum gas. Various low boiling fractions undergo Merox extraction process, in the presence of an alkali and a catalyst, leading to the formation of disulphides. Alternatively, these low boiling hydrocarbon fractions are freed from sulphur, mostly present in form of mercaptans, by washing with approx. 10% caustic solution. The extracted sodium mercaptides are water soluble and undergo facile aerial oxidation during storage in tanks to give the corresponding disulphides. These disulphides being insoluble in aqueous caustic separate out as a layer on the top. These disulphided layers pose disposal problem for refiners, as due to higher sulfur content it can neither be back blended nor can be sent to the furnace. This fraction called disulfided oil was analyzed by NMR ($^1H$ & $^{13}C$), GC and GC-MS. Their analysis indicated the presence of a mixture of dialkyldisulphides, viz., dimethyldisulide, methylethyldisulfide and diethyldisulfide. The average composition of these disulphides can be taken as $C_3H_8S_2$.

The reaction of the disulphided oil, as obtained from the caustic wash of liquefied petroleum gas, with 2,3,8,9,13,14-hexathia-5,6,11,12-tetraazatricyclo [8.2.1.14,7]tetradeca-4,6,10,12-tetraene was carried out in one pot and one step.

1.0 mole of 2,3,8,9,13,14-hexathia-5,6,11,12-tetraazatricyclo [8.2.1.14,7]tetradeca-4,6,10,12-tetraene and 2.0 to 5.0 moles of disulphided oil, preferably 2.5 to 3.0 moles are taken in a reaction flask. The reaction mixture was stirred at room temperature for one hour and then refluxed for 1-2 hrs. After completion of the reaction, the excess disulfide oil is distilled off under reduced pressure and the residue is filtered to yield the desired Corrosion inhibitor/metal deactivator, comprising of 2,5-bis(methyldithio)-1,3,4-thiadiazole, 2-methylthio-5-ethylthio-1,3,4-thiadiazole and 2,5-bis(ethyldithio)-1,3,4-thiadiazole, in quantitative yields. This product was characterized by elemental, spectroscopic and FDMS techniques. Since this cyclic disulfide contains a couple of weak sulphur-sulphur bonds, it can open up, upon heating to form the free radicals. Similarly, the disulphide oil can also give alkyl mercaptan free radicals in situ, and the recombination of the se two result in the formation of desired 2,5-bis(alkyldithio)-1,3,4-thiadiazole. The presence of the excess of disulphide oil ensures the completion of the reaction, which is monitored by complete removal of cyclic disulphide by chromatographic techniques.

The reaction can also be carried out in the presence of a polar solvent. The said polar solvent is acetonitrile, tetrahydrofuran, methyl ethyl ketone or alkyl alcohols. The said alkyl alcohol is methyl alcohol, ethyl alcohol, isopropyl alcohol or mixtures thereof. However the preferred alcohol is ethyl alcohol.

The lubricating oil composition comprises of a mixture of 0.01 to 6% of 2,5-bis(methyldithio)-1,3,4-thiadiazole, 2-methylthio-5-ethylthio-1,3,4-thiadiazole and 2,5-bis(ethyldithio)-1,3,4-thiadiazole as the corrosion inhibitor/metal passivator additive, for lubricant, grease and fuel applications.

The present invention will now be described with reference to the foregoing examples:

EXAMPLE 1

This example demonstrates the laboratory preparation of 2,5-bis (alkyldithio)-1,3,4-thiadiazole in excellent yield using 2,3,8,9,13,14-hexathia-5,6,11,12-tetraazatricyclo [8.2.1.14,7]tetradeca-4,6,10,12-tetraene and disulfide oil from waste refinery stream generated during Merox extraction/caustic wash of liquid petroleum gas.

A 1000 ml, three necked round bottomed flask was equipped with condenser, addition funnel, magnetic stirrer and thermocouple. The flask was charged with 2,3,8,9,13,14-hexathia-5,6,11,12-tetraazatricyclo [8.2.1.14,7]tetradeca-4,6,10,12-tetraene (80 g) and disulphide oil (300 gm) and the mixture was stirred at room temperature for one hour. Subsequently, the reaction mixture was heated to 110-120° C., under reflux and stirred at this temperature for 2-3 hrs. After completion of the reaction, the excess disulfide oil was removed under reduced pressure. The residual liquid was filtered to yield a corrosion inhibiting composition for lubricant, grease and fuel applications comprising of 2,5-bis(methyldithio)-1,3,4-thiadiazole, 2-methylthio-5-ethylthio 1,3,4-thiadiazole and 2,5-bis(ethyldithio)-1,3,4-thiadiazole The product obtained from the above example was evaluated for copper corrosion efficacy by ASTM D-130 test. Commercial thiadiazole type of corrosion inhibitors/metal passivators, viz. Cuvan-484, Cuvan-826 (marketed by M/s Vanderbilt, USA) and Amoco-150 (marketed by Amoco) were also evaluated.

EXAMPLE 2

This example demonstrates the laboratory preparation of 2,5-bis (alkyldithio)-1,3,4, thiadiazole in high yield using ethyl alcohol as the reaction medium.

A 1000 ml, three necked round bottomed flask was equipped with condenser, addition funnel, magnetic stirrer and thermocouple. The flask was charged with 2,3,8,9,13,14-hexathia-5,6,11,12-tetraazatricyclo [8.2.1.14,7]tetradeca-4,6,10,12-tetraene (60 g), disulphide oil (220 gm) and ethyl alcohol (500 ml). The reaction mixture was stirred at room temperature for one hour. Subsequently, the reaction mixture was refluxed at 75-80° C. for 2-3 hrs. After completion of the reaction, the excess solvent and disulfide oil was removed under reduced pressure. The residual liquid was filtered to yield a corrosion inhibiting composition for lubricant, grease and fuel applications comprising of 2,5-bis(methyldithio)-1,3,4-thiadiazole, 2-methylthio-5-ethylthio-1,3,4-thiadiazole and 2,5-bis(ethyldithio)-1,3,4-thiadiazole

EXAMPLE 3

This example demonstrates the laboratory preparation of 2,5-bis (alkyldithio)-1,3,4, thiadiazole in high yield using methyl ethyl ketone as the reaction medium.

A 1000 ml, three necked round bottomed flask was equipped with condenser, addition funnel, magnetic stirrer and thermocouple. The flask was charged with 2,3,8,9,13,14-hexathia-5,6,11,12-tetraazatricyclo [8.2.1.14,7]tetradeca-4,6,10,12-tetraene (60 g), disulphide oil (220 gm) and methyl ethyl ketone (500 ml). The reaction mixture was stirred at room temperature for one hour. Subsequently, the reaction mixture was refluxed at 75-80° C. for 2-3 hrs. After completion of the reaction, the excess solvent and disulfide oil was removed under reduced pressure. The residual liquid was filtered to yield a corrosion inhibiting composition for lubricant, grease and fuel applications comprising of 2,5-bis(methyldithio)-1,3,4-thiadiazole, 2-methylthio-5-ethylthio-1,3,4-thiadiazole and 2,5-bis(ethyldithio)-1,3,4-thiadiazole The performance of synthesized corrosion inhibitors was evaluated vis-à-vis commercial corrosion inhibitors as per ASTM D-130 test method. The arbitrary ratings for corrosion were given for various blends, with 1 being least corrosive and 4 as most corrosive. The results are tabulated in Table-1.

TABLE 1

Performance Evaluation of synthesized Corrosion Inhibitor vis-à-vis Commercial corrosion Inhibitors

| S. No. | Base Blend | Corrosion inhibitor | Copper Corrosion Rating |
|---|---|---|---|
| 1. | Base oil + 0.2% Elemental sulphur | — | 4 |
| 2. | Base Oil + 0.2% Elemental sulphur | 0.3% of Example 1 | 2 |
| 3. | Base Oil + 0.2% Elemental sulphur | 0.3% of Cuvan 826 | 2 |
| 4. | Base Oil + 4% Sulphurised Isobutylene | — | 3 |
| 5. | Base Oil + 4% Sulphurised Isobutylene | 0.2% of Example 1 | 1 |
| 6. | Base Oil + 4% Sulphurised Isobutylene | 0.2% of Cuvan 826 | 2 |
| 7. | Industrial Gear Oil formulation (without corrosion inhibitor) | — | 4 |
| 8. | Industrial Gear Oil formulation (without corrosion inhibitor) | 0.1% of Example 1 | 1 |
| 9. | Industrial Gear Oil formulation (without corrosion inhibitor) | 0.1% Amoco 150 | 2 |
| 10. | Industrial Gear Oil formulation (without corrosion inhibitor) | 0.1% Cuvan 484 | 2 |
| 11. | Industrial Gear Oil formulation (without corrosion inhibitor) | 0.1% Cuvan 826 | 1 |
| 12. | Auto Gear Oil formulation (without corrosion inhibitor) | | 4 |
| 13 | Auto Gear Oil formulation (without corrosion inhibitor) | 0.2% of Example 1 | 2 |
| 14 | Auto Gear Oil formulation (without corrosion inhibitor) | 0.2% Amoco 150 | 2 |
| 15 | Auto Gear Oil formulation (without corrosion inhibitor) | 0.2% Cuvan 484 | 3 |
| 16 | Auto Gear Oil formulation (without corrosion inhibitor) | 0.2% Cuvan 826 | 2 |
| 17 | Lithium Complex Grease (without corrosion inhibitor) | — | 3 |
| 18. | Lithium Complex Grease (without corrosion inhibitor) | 0.2% of Example 1 | 1 |
| 19. | Lithium Complex Grease (without corrosion inhibitor) | 0.2% of Cuvan 484 | 1 |

What is claimed is:

1. A corrosion inhibiting additive composition for lubricant, grease and fuel applications, comprising of a) 2,5-bis (methyldithio)-1,3,4-thiadiazole: 35-65% by weight;

b) 2-methyldithio-5-ethlyldithio-1,3,4-thiadiazole: 35-65% by weight and the balance of 2,5-bis (ethyldithio)-1,3,4-thiadiazole in order to make up to 100% by weight.

2. A process for preparing a corrosion inhibiting additive composition, by reacting 2,3,8,9,13,14-hexathia-5,6,11,12-tetraazatricyclo [8.2.1.14,7]tetradeca-4,6,10,12-tetraene, in a polar organic solvent, with disulphide oil obtained from Merox extraction/caustic wash of liquid petroleum gas.

3. A process as claimed in claim 2 wherein said 2,3,8,9,13,14-hexathia-5,6,11,12-tetraazatricyclo [8.2.1.14,7]tetradeca-4,6,10,12- tetraene is either in powder form or in solution form.

4. A process as claimed in claim 2 wherein said polar solvent is selected from acetonitrile, tetrahydrofuran, methyl ethyl ketone or alkyl alcohols.

5. A process as claimed in claim 4 wherein said alkyl alcohol is selected from methyl alcohol, ethyl alcohol, isopropyl alcohol or mixtures thereof.

6. A process as claimed in claim 5 wherein said alkyl alcohol is ethyl alcohol.

7. A process as claimed in claim 2 wherein the composition of said disulphide oil comprises at least one disulfide having formula $C_2H_6S_2$, $C_3H_8S_2$ and $C_4H_{10}S_2$.

8. A process as claimed in claim 6, wherein the ratio of the reactants 2,3,8,9,13,14-hexathia-5,6,11,12-tetraazatricyclo [8.2.1.14,7]tetradeca-4,6,10, 12-tetraene and disulphide oil is 1:2 to 1:10 mole ratio.

9. The process as claimed in claim 8, wherein the ratio of the reactants 2,3,8,9,13, 14-hexathia-5,6,11,12-tetraazatricyclo 8.2.1.14,7]tetradeca-4,6,10,12-tetraene and disulphide oil is 1:3 mole ratio.

10. A process as claimed in claim 2 comprising -reacting 2,3,8,9,13,14-hexathia-5,6,11, 12-tetraazatricyclo [8.2.1.14, 7]tetradeca-4,6,10, 12-tetraene in powder form with disulphide oil obtained from Merox extraction/caustic wash of the liquefied petroleum gas, heating the reaction mixture to 120-140 C and cooling the said reaction mixture to room temperature to get pale yellow corrosion inhibiting composition comprising of 2,5-bis(methyldithio)-1,3,4-thiadiazole, 2-methylthio-5-ethylthio-1,3,4-thiadiazole and 2,5-bis(ethyldithio)-1,3,4-thiadiazole.

11. The process as claimed in claim 10, wherein the ratio of 2,3,8,9,13,14-hexathia-5,6,11, 12-tetraazatricyclo [8.2.1.14, 7]tetradeca-4,6,10, 12-tetraene and disulphide oil is 1:2 to 1:10 mole ratio.

12. The process as claimed in claim 11, wherein the ratio of 2,3,8,9,13,14-hexathia-5,6,11,12-tetraazatricyclo [8.2.1.14, 7]tetradeca-4-,6,10,12-tetraene and disulphide oil is 1:3 mole ratio.

* * * * *